US011174085B2

(12) United States Patent
Bellamah

(10) Patent No.: US 11,174,085 B2
(45) Date of Patent: *Nov. 16, 2021

(54) AUTO OPENING CIGARETTE PACK OUTSERT

(71) Applicant: Altria Client Services LLC, Richmond, VA (US)

(72) Inventor: Stephen Bellamah, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/876,464

(22) Filed: May 18, 2020

(65) Prior Publication Data

US 2020/0277119 A1 Sep. 3, 2020

Related U.S. Application Data

(63) Continuation of application No. 16/011,946, filed on Jun. 19, 2018, now Pat. No. 10,683,153, which is a (Continued)

(51) Int. Cl.
*B65D 75/68* (2006.01)
*B65D 5/42* (2006.01)
(Continued)

(52) U.S. Cl.
CPC ..... *B65D 75/68* (2013.01); *A24F 15/00* (2013.01); *B65D 5/4233* (2013.01);
(Continued)

(58) Field of Classification Search
CPC ..... A24F 15/00; A24F 15/08; A24F 15/12; A24F 15/18; B65D 5/42; B65D 5/4233;
(Continued)

(56) References Cited

U.S. PATENT DOCUMENTS 2,191,704 A * 2/1940 Bennett ..... B44C 1/1733 206/813
3,606,138 A * 9/1971 Allison ..... B42D 15/08 229/70
(Continued)

FOREIGN PATENT DOCUMENTS

EP 2985239 A1 2/2016
FR 2591195 A1 6/1987
(Continued)

OTHER PUBLICATIONS

International Search Report and Written Opinion of the International Searching Authority dated Sep. 1, 2017 in corresponding International Patent Application No. PCT/US17/46406 (3 pages).

*Primary Examiner* — Bryon P Gehman
(74) *Attorney, Agent, or Firm* — Harness, Dickey & Pierce, P.L.C.

(57) ABSTRACT

An outsert for affixing to a product package includes a base layer, a top layer, and a printed document. The base layer includes a perforated region arranged to be aligned with a tear tape on an outer wrapping of the package. The top layer is arranged on the base layer and has one or more edge regions adhered to the base layer. The printed document is enclosed in an inner volume established between the base
(Continued)

layer and top layer. A laminate layer can be disposed in the inner volume between the top layer and the printed document to increase the rigidity of the outsert.

19 Claims, 3 Drawing Sheets

Related U.S. Application Data continuation of application No. 15/239,076, filed on Aug. 17, 2016, now Pat. No. 10,023,375.

(51) Int. Cl.
*B65D 85/10* (2006.01)
*A24F 15/00* (2020.01)
*B65D 75/54* (2006.01)

(52) U.S. Cl.
CPC ..... *B65D 75/545* (2013.01); *B65D 85/10* (2013.01); *B65D 85/1027* (2013.01)

(58) Field of Classification Search
CPC ..... B65D 75/54; B65D 75/545; B65D 75/68; B65D 85/10; B65D 85/1027; B65D 85/1045; B65D 85/109
See application file for complete search history.

(56) References Cited

U.S. PATENT DOCUMENTS

| | | | | |
|---|---|---|---|---|
| 3,695,422 | A * | 10/1972 | Tripodi | B65D 75/54 206/232 |
| 5,035,935 | A * | 7/1991 | Thomas | B65D 75/54 428/43 |
| 5,250,134 | A | 10/1993 | Thomas et al. | |
| 6,036,006 | A * | 3/2000 | Focke | B65D 5/4233 206/264 |
| 6,467,614 | B1 * | 10/2002 | Tallier | B31D 1/021 206/264 |
| 6,513,651 | B1 | 2/2003 | Focke et al. | |
| 7,527,844 | B2 | 5/2009 | Tallier et al. | |
| 7,971,711 | B2 * | 7/2011 | Squarzoni | G09F 23/02 206/242 |
| 10,308,412 | B2 * | 6/2019 | Polikeit | B65D 75/04 |
| 2005/0142315 | A1 | 6/2005 | DeSimone et al. | |
| 2008/0128300 | A1 | 6/2008 | Bahar et al. | |
| 2016/0227835 | A1 * | 8/2016 | Swede | B65D 5/5415 |

FOREIGN PATENT DOCUMENTS

| | | |
|---|---|---|
| GB | 2493905 A | 2/2013 |
| WO | WO-9627177 A1 | 9/1996 |

* cited by examiner

AUTO OPENING CIGARETTE PACK OUTSERT

RELATED APPLICATIONS

This application is a continuation patent application of U.S. patent application Ser. No. 16/011,946, filed Jun. 19, 2018, which is a continuation patent application of U.S. patent application Ser. No. 15/239,076, filed Aug. 17, 2016, now U.S. Pat. No. 10,023,375, issued Jul. 17, 2018, the entire contents of each is incorporated herein by reference in its entirety.

FIELD

The present disclosure relates to cigarette packaging and particularly to an outsert for cigarette packaging.

BACKGROUND

Various techniques and designs have been used to attach or include coupons or other documentation on product packaging. In the case of cigarette packaging, documentation is typically attached as an insert where a booklet or folded printed document is provided on the cigarette pack and within the outer wrapping of the package.

Known designs and variations thereof can require several steps of the consumer to access the documentation including separately opening the outer wrapping of the cigarette pack and the packaging containing the documentation. In addition, access to the documentation can be difficult due to the manner in which the documentation is attached to the packaging. Moreover, the technique used to attach the documentation to the packaging can obscure the design, text, and/or images on the face of the packaging.

SUMMARY

An exemplary outsert for affixing to a product package is disclosed comprising: a base layer having a perforated region arranged to be aligned with a tear tape on an outer wrapping of the package; a top layer arranged on the base layer and having one or more edge regions adhered to the base layer; and a printed document enclosed in an inner volume established between the base layer and top layer.

An exemplary product package is disclosed, comprising: an outer wrapping provided with an integrated tear tape for opening the package; and an outsert adhered to an outer surface of the outer wrapping, the outsert having a perforated region aligned with a tear line of the tear tape and a printed document accommodated in an inner volume of the outsert, wherein the outsert is arranged to be opened along a perforated line of the perforated region via the tear tape so that the printed document within the inner volume is immediately accessible upon initial opening of the package.

BRIEF DESCRIPTION OF THE DRAWING FIGURES

The scope of the present disclosure is best understood from the following detailed description of exemplary embodiments when read in conjunction with the accompanying drawings, wherein.

DETAILED DESCRIPTION

Reference will now be made in detail to the various embodiments, one or more examples of which are illustrated in each figure. Each example is provided by way of explanation and is not meant as a limitation. For example, features and/or method steps illustrated or described as part of one embodiment and/or method can be used on or in conjunction with other exemplary embodiments and/or method steps to yield yet further exemplary embodiments or methods. It is intended that the present disclosure includes such modifications and variations.

Exemplary embodiments are directed to an outsert that can be affixed to the outer wrapping of a cigarette pack. The outsert has perforations so that when a tear tape is drawn to tear or sever the outer wrapping, the packaging of the outsert is simultaneously severed and the printed document enclosed in the outsert can be accessed. The outsert provides efficient and immediate access to the printed document, a clean appearance after removal, minimal impact to the consumer's experience, and does not change the utilization of the pack film by consumers.

Figure 1:
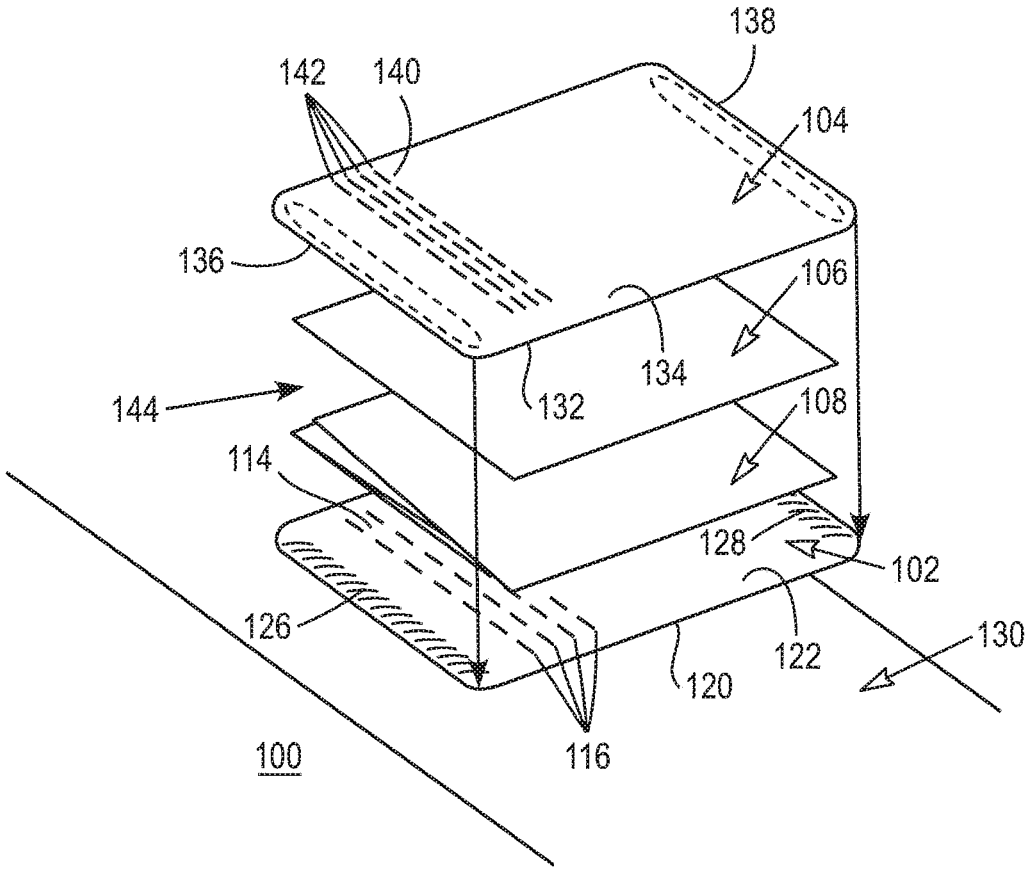
FIG. 1 illustrates a perspective view of outsert in accordance with an exemplary embodiment.
Figure 2:
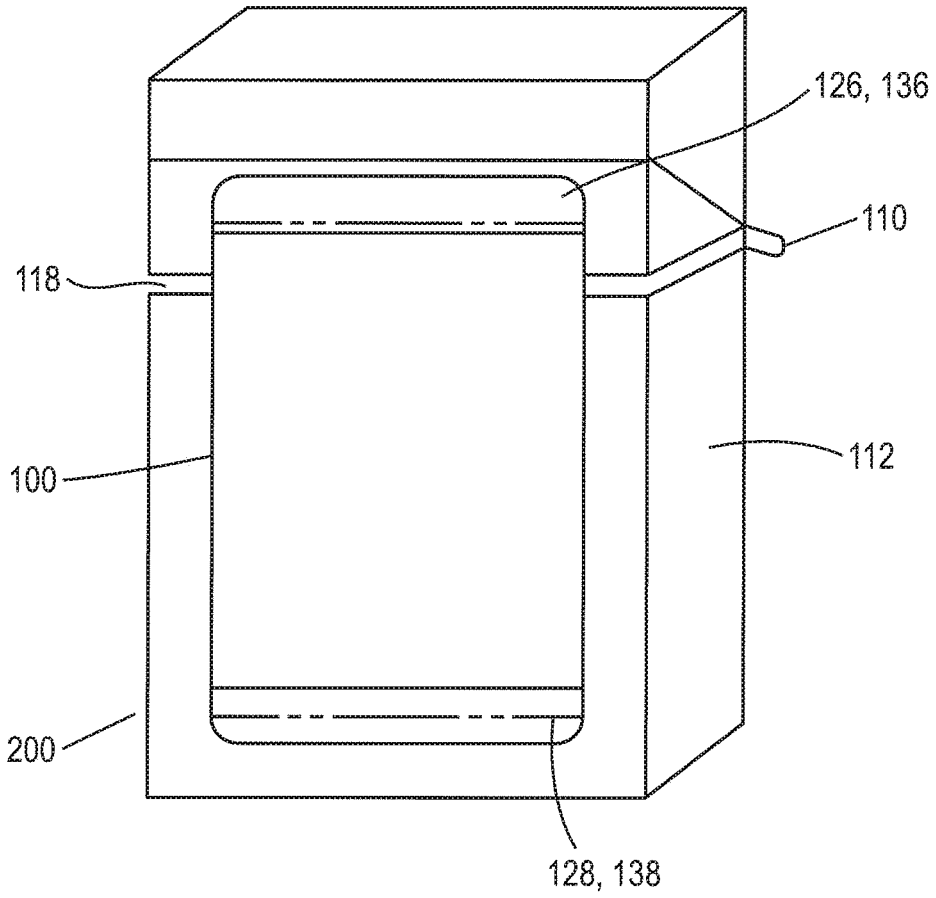
FIG. 2 illustrates an outsert affixed to a cigarette pack in accordance with an exemplary embodiment.

FIG. 1 illustrates a perspective view of an outsert in accordance with an exemplary embodiment. FIG. 2 illustrates an outsert affixed to a cigarette pack in accordance with an exemplary embodiment. As shown in FIGS. 1 and 2, the outsert 100 includes a base layer 102, a top layer 104, and a printed document 108. In an exemplary embodiment, the outsert 100 can also include a laminate layer 106. The outsert 100 can have any desired shape or size suitable for attachment to a product using a tear tape 110 to open an outer film or outer wrapping 112. For example, in an exemplary embodiment the outsert 100 can be substantially rectangular in shape (e.g., longer in length than width) for partially covering and adhering to a face of a cigarette pack, which uses tear tape 110 to open the outer film or wrapping 112.

The base layer 102 includes a perforated region 114, which has one or more perforated lines 116. The perforated lines 116 are preferably parallel and spaced such that one or more perforated lines 116 can be aligned to engage the tear tape 110 of the outer film or wrapping 112 along a tear line 118. The perforated lines 116 extend substantially across an entire length or width of the base layer 102. The perforated lines 116 can extend up to an edge or edge region of the base layer 102. The base layer 102 can be formed of a transparent film to allow the product package to be clearly visible when the outsert 100 is opened via the tear tape 110. According to another exemplary embodiment the base layer 102 can be formed of a semi-transparent, opaque, tinted, or non-transparent material as desired. The material composition of the base layer 102 is such that perfect alignment of the one or more perforated lines 116 with the tear line 118 of the tear tape 110 is not required. Even if the tear line 118 of the tear tape 110 is aligned to fall between two perforated lines 116, the force necessary to draw the tear tape 110 along the tear line 118 is preferably sufficient to break or tear one or more of the perforated lines 116.

The base layer 102 has an outer side 120 and an inner side 122. The outer side 120 of the base layer 102 has an adhesive applied thereon which enables it to adhere to the outer wrapping 112 of the product. Prior to being applied to a product, the outer side 120 of the base layer 102 is covered by a removable liner 130. The inner side 122 has an adhesive applied to a top edge region 126 and a bottom edge region 128 for adhering to the top layer 104.

The top layer 104 is configured to be of substantially the same shape and size as the base layer 102. The top layer 104 can be formed of a transparent material, which allows the printed document 108 to be visible when the outsert 100 unopened. According to another exemplary embodiment the top layer 104 can be formed of a semi-transparent, opaque, tinted, or non-transparent material as desired if visibility of the original product packaging and printed documentation 108 is not specified. The top layer 104 has an inner side 132 and outer side 134. The inner side 132 of the top layer 104 can have an adhesive applied to a top edge region 136 and a bottom edge region 138 so that the top layer 104 can adhere to the top edge region 126 and bottom edge region 128, respectively, of the base layer 102. According to an exemplary embodiment, the adhesive can be applied to one of the inner side 122 of the base layer 102 at the top and bottom edge regions 126, 128 or to the inner side 132 of the top layer 104 at the top and bottom edge regions 136, 138. In yet another exemplary embodiment, the outer side 134 of the top layer 104 can include a perforated region 140 with one or more perforated lines 142. For example, the perforated lines 142 can extend substantially across an entire length or width of the top layer 104. The perforated lines 142 can extend up to an edge or edge region of the top layer 104. The perforated region 140 of the top layer 104 can overlay the perforated region 116 of the base layer 102 when the top layer 104 is adhered to the bottom layer 102.

The laminate layer 106 can be encapsulated in an inner volume 144 established between the base layer 102 and the top layer 104. The laminate layer 106 is configured to provide rigidity to the outsert 100 and can be formed of semi-rigid and/or flexible film that is transparent, semi-transparent, or opaque. The laminate layer 106 can be positioned between the printed document 108 and the top layer 104. The laminate layer 106 has a size and shape suitable for fitting within the inner volume 144, and can partially or fully cover the perforated region 114 of the base layer 102. The laminate layer 106 can be positioned such that when the tear tape 110 is drawn along the tear line 118, the laminate layer 106 and the printed document 108 are lifted away from the base layer 102.

The printed document 108 can be a folded or unfolded pamphlet, coupon, notice, booklet, or any other printed documentation as desired. The printed document 108 is configured to be encapsulated (e.g., encased, enclosed) in the inner volume 144 between the base layer 102 and top layer 104. The printed document 108 can have a size and shape sufficient to partially or fully cover the perforated region 114 of the base layer 102 or not overlap the perforated region 114 at all. The printed document 108 can be positioned such that when the tear tape 110 is drawn along the tear line 118, the printed document 108 and the laminate layer 106 are lifted away from the base layer 102. According to an exemplary embodiment, the printed document 108 can be folded over any number of times to accommodate the printed document 108 within the inner volume 144.

FIG. 2 illustrates an outsert affixed to a cigarette pack in accordance with an exemplary embodiment. As shown in FIG. 2, the outsert 100 can be affixed to a face of the product package. For example, in an exemplary embodiment the outsert 100 can be affixed to a cigarette pack 200. The outsert 100 is attached to the outer wrapping 112 of the cigarette pack 200 via the adhesive on the outer side 122 of the base layer 102. The perforated region 116 of the base layer 102 is aligned with the tear tape 110. When the tear tape 110 is drawn or pulled along the tear line 118, the drawing or pulling force severs (e.g., tears) the base layer 102 at the perforated region 114. At the same time, the printed document 108 and the laminate layer 106 are lifted away from the inner side 122 of base layer 102 and the top layer 104 is separated from the base layer 102 via at least one of the top and bottom edges 136, 138. The base layer 102 is configured to separate into two portions along the perforated lines 116 of the perforated region 114, when the outer wrapping of the cigarette pack 200 is opened for the first time via the tear tape 110.

Figure 3:
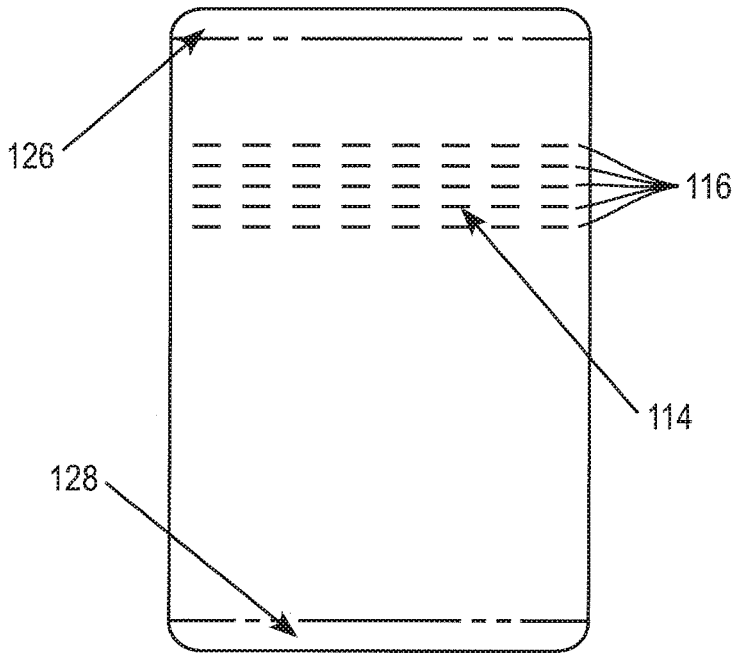
FIG. 3 illustrates perforations of an outsert in accordance with an exemplary embodiment.

FIG. 3 illustrates base layer of an outsert in accordance with an exemplary embodiment. As shown in FIG. 3, an exemplary base layer 102 can be formed in a rectangular shape. The perforated region 114 is arranged in an upper half of the base layer 102. According to an exemplary embodiment, the perforated region 114 can be arranged in an area of the base layer 102 which overlies a location providing engagement of the tear tape 110 on the product packaging. The base layer 102 is configured to separate into two portions along the perforated lines 116 of the perforated region 114, when the outer wrapping 112 of the cigarette pack 200 is opened via the tear tape 110.

Although specific features of various exemplary embodiments of the disclosure can be shown in some drawings and not in others, this is for convenience only. In accordance with the principles of the disclosure, any feature of a drawing can be referenced and/or claimed in combination with any feature of any other drawing.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A product package including an outsert comprising:

a base layer having a perforated region overlying and aligned with a tear tape on an outer wrapping of the package;

a top layer over the base layer with one or more edge regions of the top layer adhered to the base layer; and a printed document enclosed in an inner volume established between the base layer and top layer, the base layer and the top layer each being a transparent film.

2. The product package according to claim 1, wherein the perforated region includes at least one line with perforations extending across the base layer.

3. The product package according to claim 1, wherein the perforated region includes a plurality of parallel lines with perforations extending across the base layer.

4. The product package according to claim 1, wherein at least part of the top layer is configured to separate from the base layer via the tear tape.

5. The product package according to claim 1, wherein the base layer is configured to separate into multiple portions upon opening of the package via the tear tape.

6. The product package according to claim 1, wherein the base layer has a top edge portion and a bottom edge portion adhered to the top layer.

7. The product package according to claim 1, wherein the base layer comprises a semi-transparent, opaque, tinted or non-transparent material.

8. The product package according to claim 1, wherein the perforated region includes a plurality of parallel lines with perforations extending across the base layer, at least part of the top layer is configured to separate from the base layer via the tear tape, the base layer is configured to separate into multiple portions upon opening of the package via the tear tape, and the base layer has a top edge portion and a bottom edge portion adhered to the top layer.

9. The product package according to claim 1, wherein the top layer has an inner side with an adhesive at a top edge region and at a bottom edge region.

10. The product package according to claim 1, wherein the perforated region of the base layer is a first perforated region and the top layer includes a second perforated region that overlays the first perforated region.

11. The product package according to claim 10, wherein the second perforated region includes at least one line with perforations.

12. The product package according to claim 10, wherein the second perforated region includes a plurality of lines with perforations.

13. The product package according to claim 1, wherein a laminate layer is disposed in the inner volume between the top layer and the printed document.

14. The product package according to claim 13, wherein the laminate layer at least partially covers the perforated region of the base layer.

15. The product package according to claim 1, wherein the printed document at least partially covers the perforated region of the base layer.

16. The product package of claim 1, wherein the product package is a cigarette pack.

17. The product package of claim 16, wherein the base layer is rectangular in shape and overlies one face of the cigarette pack.

18. The product package of claim 17, wherein the perforated region extends across a width of the base layer.

19. The product package of claim 18, wherein the top layer is rectangular in shape and includes a perforated region overlying and aligned with the perforated region of the base layer, the printed document arranged with a portion thereof between the perforated region of the base layer and the perforated region of the top layer.

* * * * *